US007210680B2

(12) United States Patent
Yoneda et al.

(10) Patent No.: US 7,210,680 B2
(45) Date of Patent: May 1, 2007

(54) SHEET CONVEYING APPARATUS AND IMAGE FORMING APPARATUS USING THE SAME

(75) Inventors: Yoshiharu Yoneda, Nara (JP); Tatsuya Inoue, Nara (JP); Mitsuo Matsuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 358 days.

(21) Appl. No.: 10/781,024

(22) Filed: Feb. 17, 2004

(65) Prior Publication Data

US 2004/0164485 A1 Aug. 26, 2004

(30) Foreign Application Priority Data

Feb. 25, 2003 (JP) ..... 2003-048095

(51) Int. Cl.
*B65H 5/06* (2006.01)

(52) U.S. Cl. ..... 271/274; 271/273

(58) Field of Classification Search ..... 271/272, 271/273, 274, 162, 164; 399/361
See application file for complete search history.

(56) References Cited

U.S. PATENT DOCUMENTS 4,640,604 A * 2/1987 Kozuka et al. ..... 399/124
4,908,674 A * 3/1990 Fukano et al. ..... 399/124
5,085,422 A * 2/1992 Sagara ..... 271/162
5,842,692 A * 12/1998 Rutishauser ..... 271/3.2
5,971,388 A * 10/1999 Hattori et al. ..... 271/10.03
2003/0231911 A1* 12/2003 Kida et al. ..... 399/361

FOREIGN PATENT DOCUMENTS

| | | | |
|---|---|---|---|
| JP | 03128838 | A * | 5/1991 |
| JP | 04333444 | A * | 11/1992 |
| JP | 05132184 | A * | 5/1993 |
| JP | 05319618 | A * | 12/1993 |
| JP | 07-157132 | | 6/1995 |
| JP | 10-029740 | | 2/1998 |
| JP | 11-322117 | | 11/1999 |
| JP | 2000-016619 | | 1/2000 |

* cited by examiner

*Primary Examiner*—Patrick Mackey
*Assistant Examiner*—Kaitlin Joerger
(74) *Attorney, Agent, or Firm*—David G. Conlin; David A. Tucker; Edwards Angell Palmer & Dodge LLP

(57) ABSTRACT

An image forming apparatus including a sheet conveying apparatus. When a sheet is jammed in a first conveying path, a first unit is pulled out in a direction substantially parallel to a first conveying path. In this way, a driven roller and a driving roller are separated from each other, and a work space is created. The jammed sheet is thus exposed to the first conveying path. It is therefore easy to put a hand into the work space and remove the sheet. This allows for easy maintenance, and easy operation for removing a sheet retained in the apparatus.

14 Claims, 8 Drawing Sheets

SHEET CONVEYING APPARATUS AND IMAGE FORMING APPARATUS USING THE SAME

This Nonprovisional application claims priority under 35 U.S.C. § 119(a) on Patent Application No. 2003/048095 filed in Japan on Feb. 25, 2003, the entire contents of which are hereby incorporated by reference.

FIELD OF THE INVENTION

The present invention relates to a sheet conveying apparatus, and an image forming apparatus using the same. More specifically, the present invention relates to a sheet conveying apparatus for conveying a sheet via a conveying path, and relates to an image forming apparatus using the sheet conveying apparatus. The sheet conveying apparatus is provided to a body apparatus of an image forming apparatus and the like, e.g. a printer, a facsimile, and a copying apparatus.

BACKGROUND OF THE INVENTION

In an image forming apparatus such as a printer, a facsimile, a copying apparatus, or the like, a sheet (e.g. a sheet of paper) is supplied to an image forming section via a conveying path from a feed tray provided at a lower portion of the image forming apparatus. The feed tray is a tray for containing a sheet to be used for image forming. Usually, the feed tray contains a standard-size sheet, which is widely used, suitable for image forming, and easy to convey.

However, a sheet used for image forming is not always the sheet contained in the feed tray. There are cases in which a special sheet is used for image forming. Examples of such a special sheet are (i) a thin sheet, (ii) a thick sheet such as a post card or the like, (iii) a colored sheet, and (iv) a sheet such as a plastic film sheet, which is made of a material different from that of a usual sheet. Such a special sheet, which is used in rare cases, is difficult to feed by using the feed tray provided inside an image forming apparatus.

Moreover, because such a special sheet is used only in rare cases, if a special sheet is always contained in the feed tray which is limited in number, the feed tray cannot be used efficiently. Therefore, before and after using special sheets, it is usually necessary to replace standard sheets contained in the feed tray with the special sheets, and vice versa. This requires a lot of time and labor. In order to overcome this drawback, many usual image forming apparatuses are provided with a feed slot outside the image forming apparatus, and a manual feed tray (i.e. a sheet conveying apparatus) for supplying a special sheet to the image forming apparatus conveniently.

Recently, image forming by an image forming apparatus is performed at an increasingly high speed. Therefore, an increasingly large number of sheets are consumed within a unit time. As a result, a usual feed tray quickly runs out of sheets. Every time a usual feed tray runs out of sheets, it is necessary to refill sheets. In many cases, therefore, an image forming apparatus is externally provided with a large-capacity sheet conveying apparatus, so as to reduce the number of sheet-refilling and save the time and labor required.

If the manual feed tray (i.e. the sheet conveying apparatus) or the large-capacity sheet conveying apparatus is provided, the image forming apparatus requires conveying paths. Through the conveying paths, the sheet is conveyed and supplied to the image forming section of a main body of the image forming apparatus. Therefore, such an image forming apparatus has a complex structure with many conveying paths. In some cases, one conveying path is provided over the other. In other cases, it is necessary to provide a very long conveying path from the sheet conveying apparatus to an inside of the main body of the image forming apparatus. In these cases, when a sheet is retained in a conveying path due to a paper jam or the like trouble, and the image forming apparatus comes to an emergency halt, it is often difficult to remove the sheet retained. It is especially difficult to remove a sheet retained in a conveying path that runs from the sheet conveying apparatus toward an inside of the image forming apparatus. For example, in order to open the conveying path, it is necessary to pull out a feed tray toward a front side of the image forming apparatus, i.e. in a direction perpendicular to a sheet conveying direction. In this case, the feed tray to be pulled out is the feed tray that is provided in a vicinity of the conveying path.

Thus, conventional image forming apparatuses have a problem that it is very difficult to remove a sheet from an opened portion if a direction of an opening of the conveying path is perpendicular to the sheet conveying direction. Moreover, if one conveying path is provided over the other, it is necessary to pull out two units, i.e. upper one and lower one, in order to open the conveying paths. This further complicates the structure of the image forming apparatus. Besides, this lowers work efficiency.

In order to solve these problems, there are proposed, for example, image forming apparatuses of Japanese Publication for Unexamined Patent Application, Tokukai 2000-16619 (publication date: Jan. 18, 2000), Japanese Publication for Unexamined Patent Application, Tokukaihei 11-322117 (publication date: Nov. 24, 1999), and the like.

Specifically, for example, the image forming apparatus of Tokukai 2000-16619 is arranged so that a large-capacity cassette (i.e. a sheet conveying apparatus) and a pair of conveying rollers are integrally pulled out in a direction opposite the sheet conveying direction. On the other hand, the image forming apparatus of Tokukaihei 11-322117 is arranged so that a manual feed tray (i.e. a sheet conveying apparatus) and a pair of registration rollers are integrally pulled out in a direction parallel to the sheet conveying direction, whereas a transferring belt is left inside the image forming apparatus.

According to these arrangements, a sufficient work space is created when a paper jam occurs. Therefore, a jammed sheet can be removed easily.

However, as described above, the image forming apparatuses of Tokukai 2000-16619 and Tokukaihei 11-322117 are arranged so that the pair of conveying rollers for conveying a sheet are pulled out integrally when the sheet conveying apparatus is pulled out. Therefore, if a sheet is jammed between the pair of conveying rollers provided to the sheet conveying apparatus, the sheet remains sandwiched between the pair of conveying rollers even after the sheet conveying apparatus is pulled out. In order to remove the sheet sandwiched between the pair of conveying rollers, the sheet needs to be pulled in the sheet conveying direction. Thus, the sheet is subjected to a stress. As a result, work efficiency is low, because the jammed sheet cannot be removed easily.

SUMMARY OF THE INVENTION

The present invention was made in light of the foregoing problems. An object of the present invention is therefore to provide (i) a sheet conveying apparatus and (ii) an image forming apparatus using the sheet conveying apparatus, the sheet conveying apparatus being arranged so that it is easy to perform maintenance and a process for removing a sheet retained in the apparatus. More specifically, an object of the present invention is particularly to provide (i) a sheet conveying apparatus and (ii) an image forming apparatus using the sheet conveying apparatus, the sheet conveying apparatus being arranged so that it is easy to perform a process for removing, (a) a sheet retained in a conveying path through which the sheet is conveyed from the sheet conveying apparatus and (b) a sheet retained in a conveying path that runs from the sheet conveying apparatus to an inside of the image forming apparatus.

In order to solve the problems above, in a sheet conveying apparatus of the present invention including (i) a pair of conveying rollers for sandwiching a sheet and conveying the sheet in a predetermined direction and (ii) a supporting body for supporting the pair of conveying rollers, the sheet conveying apparatus conveying the sheet via a conveying path through which the sheet is conveyed by the pair of conveying rollers, the supporting body includes (a) a first unit having one of the pair of conveying rollers and (b) a second unit having the other of the pair of conveying rollers, and the first unit and the second unit are separable from each other.

According to this arrangement, the first unit and the second unit are separable from each other. When the first unit and the second unit are separated, the conveying path is opened. As a result, a large work space is created at an initial position of the first unit. At the same time, the pair of conveying rollers are also separated from each other.

Therefore, when the first unit and the second unit are separated in case a sheet is retained in the conveying path, the sheet sandwiched between the pair of conveying rollers is supported only by one of the rollers. The retained sheet is thus exposed to the work space created by separating the first unit and the second unit. As a result, it is easy to perform operation (jam handling) for removing the retained sheet, because it is not necessary to pull out the sheet from between the pair of conveying rollers. Moreover, because the work space is created, maintenance is easy.

In conventional sheet conveying apparatuses, if a sheet is retained in a conveying path, a pair of conveying rollers are pulled out integrally. Therefore, unlike the sheet conveying apparatus of the present invention, the retained sheet is not exposed, because the sheet remains sandwiched between the pair of conveying rollers. As a result, it is not easy to perform the operation (jam handling) for removing the sheet retained in the conveying path.

In order to solve the problems above, in a sheet conveying apparatus of the present invention including (i) a first pair of conveying rollers for sandwiching a sheet and conveying the sheet in a predetermined direction, (ii) a second pair of conveying rollers for sandwiching a sheet and conveying the sheet in a predetermined direction, the first pair of the conveying rollers and the second pair of conveying rollers facing each other, and (iii) supporting bodies for respectively supporting the first pair of conveying rollers and the second pair of conveying rollers, the sheet conveying apparatus conveying a sheet through a first conveying path and a second conveying path, the first conveying path being a conveying path through which a sheet is conveyed by the first pair of conveying rollers, the second conveying path being a conveying path through which a sheet is conveyed by the second pair of conveying rollers, the second conveying path being connected with the first conveying path in a downstream of the first pair of conveying rollers provided in the first conveying path, the supporting bodies includes (a) a third unit having the first pair of conveying rollers and one of the second pair of conveying rollers, and (b) a fourth unit having the other of the second pair of conveying rollers, and the third unit and the fourth unit are separable from each other.

According to this arrangement, the third unit and the fourth unit are separable from each other. When the third unit and the fourth unit are separated, a large work space is created at an initial position of the third unit. Thus, the second conveying path, including a connecting part connected with the first conveying path, is opened. At the same time, the second pair of conveying rollers are also separated from each other.

Therefore, when the third unit and the fourth unit are separated from each other in case a sheet is retained in the second conveying path, the second pair of conveying rollers are separated from each other. Thus, the sheet sandwiched between the second pair of conveying rollers is supported only by one of the second pair of conveying rollers. The retained sheet is thus exposed to the work space created by separating the third unit and the fourth unit. As a result, it is easy to perform the operation (the jam handling) for removing the retained sheet, because it is not necessary to pull out the sheet from between the second pair of conveying rollers. Moreover, because the work space is created, maintenance is easy.

A sheet conveying apparatus of the present invention may be the sheet conveying apparatus, wherein the first unit and the second unit are separated from each other in a direction substantially parallel to the conveying path, or the the third unit and the fourth unit are separated from each other in a direction substantially parallel to the first conveying path and the second conveying path.

According to this arrangement, the units are separated from each other in the direction substantially parallel to the first conveying path. Therefore, only a light stress is applied to a sheet retained in the conveying path. In addition, a smaller space is required for the separation as compared with a case in which the units are separated in such a manner as to open and expose the conveying path. Therefore, it is possible to separate those portions of the units that are deep inside the conveying path, thereby creating a sufficient work space. As a result, it is easy to perform the operation (the jam handling) for removing the jammed sheet.

A sheet conveying apparatus of the present invention may be the sheet conveying apparatus, wherein (i) one of the first unit and the second unit or (ii) one of the third unit and the fourth unit is detached in a direction opposite the sheet conveying direction.

According to this arrangement, (i) one of the first unit and the second unit or (ii) one of the third unit and the fourth unit are detached so that a direction of separating the units is opposite the sheet conveying direction. With this arrangement, the conveying roller that is pulled out is moved in the direction opposite the sheet conveying direction. That is, the roller is moved in a direction of returning a sheet that has been conveyed. With this arrangement, it is possible to avoid jamming a retained sheet into the sheet conveying direction. Moreover, because the sheet is subjected to no stress if the roller is moved in the direction opposite the sheet conveying direction, it is possible to perform the operation (the jam handling) for removing the retained sheet more easily.

A sheet conveying apparatus of the present invention may be the sheet conveying apparatus, wherein at least one of the pair of conveying rollers separated is supported on the first unit or the second unit by a movable supporting member for supporting the at least one of the pair of conveying rollers in such a manner that the at least one of the pair of conveying rollers is movable in a direction substantially parallel to a direction of separating the first unit and the second unit.

As described above, when the first unit or the third unit is pulled out, and the operation (the jam handling) for removing the sheet retained in the conveying path is completed, the first unit or the third unit is restored to an initial position thereof, so as to restart conveying a sheet. At this time, the pair of conveying rollers contact each other, and the rollers are subjected to a shock. The shock can cause damages to the rollers, displace a contact position of the pair of conveying rollers, and/or cause the pair of conveying rollers to be shaky. As a result, sheet conveying performance is deteriorated, and troubles such as skewing, wrinkling, and the like occur easily.

However, according to the foregoing arrangement, at least one of the pair of conveying rollers separated when (i) the first unit and the second unit or (ii) the third unit and the fourth unit are separated from each other is supported by the movable supporting member for supporting the at least one of the pair of conveying rollers in such a manner that the at least one of the pair of conveying rollers is movable in the direction substantially parallel to a direction of separating (i) the first unit and the second unit or (ii) the third unit and the fourth unit. With this arrangement, due to a shock caused when the pair of conveying rollers are restored to initial positions thereof after the pair of conveying rollers are separated, the roller that has the movable supporting member is moved in a direction of the shock, that is, in the direction substantially parallel to the direction of separating (i) the first unit and the second unit or (ii) the third unit and the fourth unit.

With this arrangement, it is possible to mitigate the shock caused when the pair of conveying rollers are restored. That is, the movable supporting member functions as a shock absorber for mitigating the shock caused when the pair of conveying rollers contact each other. Therefore, it is possible to prevent (i) damages to the rollers, (ii) deterioration of positioning of the rollers, and (iii) deterioration of a contact state of the rollers. As a result, it is possible to always maintain excellent sheet conveying performance, thereby preventing troubles such as skewing, wrinkling, and the like.

In the sheet conveying apparatus of the present invention, it is preferable that the roller that is supported by the movable supporting member is a driven roller.

According to this arrangement, the roller that has the movable supporting member for mitigating a shock is a driven roller that rotates when driven, that is, a driven roller that mitigates the shock caused by a contact between the rollers when the units are restored after a retained sheet is removed. Because a driven roller requires no driving source, it is not necessary to consider a connection with a driving source, supply of power, and the like. As a result, the arrangement is simplified.

In order to solve the problems above, an image forming apparatus of the present invention includes (i) the sheet conveying apparatus and (ii) a printing apparatus for performing printing on the sheet.

With this arrangement, because the sheet conveying apparatus of the present invention is used, the image forming apparatus is such that it is possible to create a work space so that a sheet jammed on its way from the sheet conveying apparatus to the image forming apparatus can be removed easily.

For a fuller understanding of the nature and advantages of the invention, reference should be made to the ensuing detailed description taken in conjunction with the accompanying drawings.

DESCRIPTION OF THE EMBODIMENTS

With reference to FIGS. 1 to 8, the following embodiments describe the present invention. Note that the present invention is not limited to the following embodiments.

First Embodiment

Figure 1:
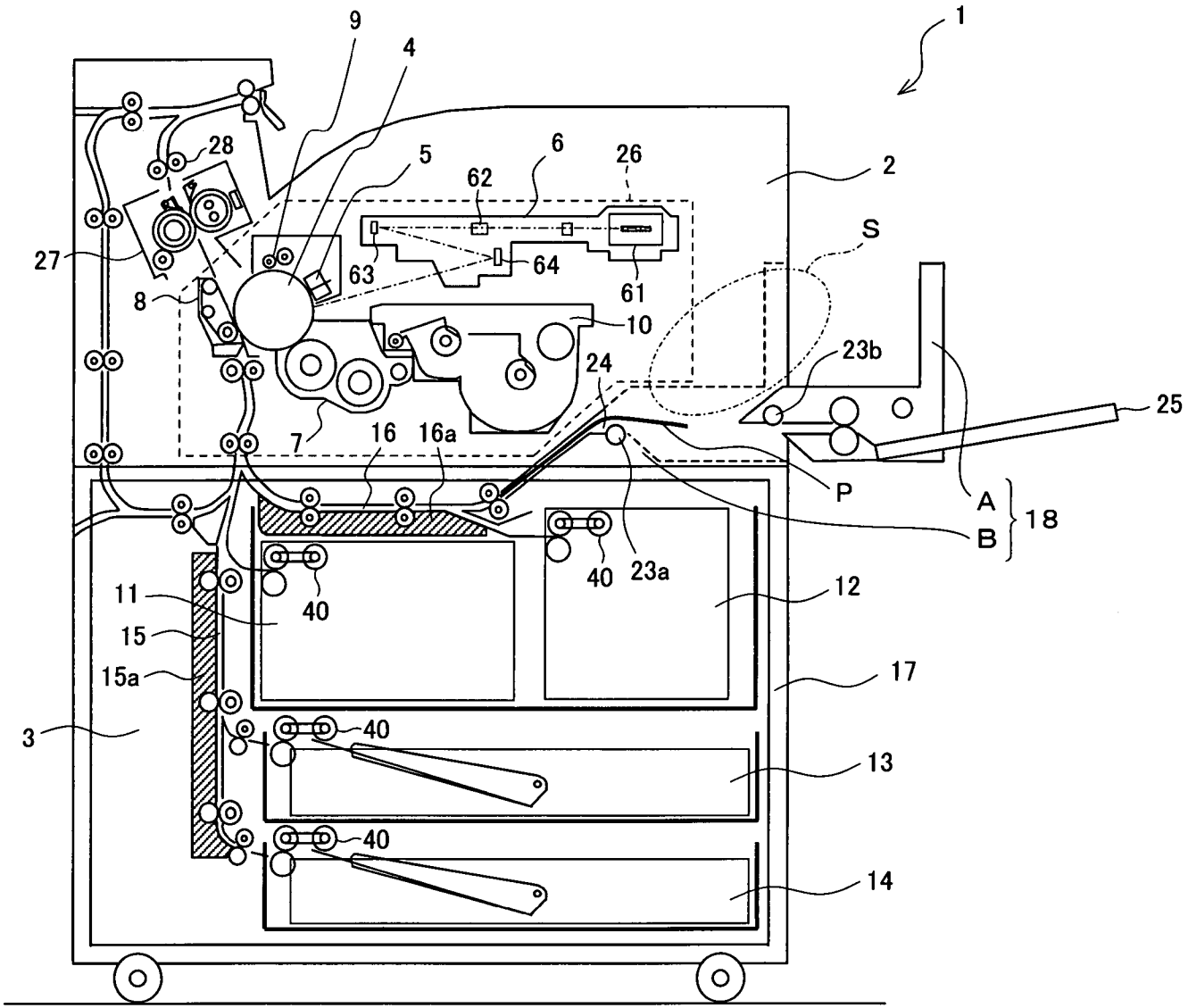
FIG. 1 is a cross-sectional view illustrating an image forming apparatus of a first embodiment of the present invention, where a manual feed unit is pulled out.
Figure 2:
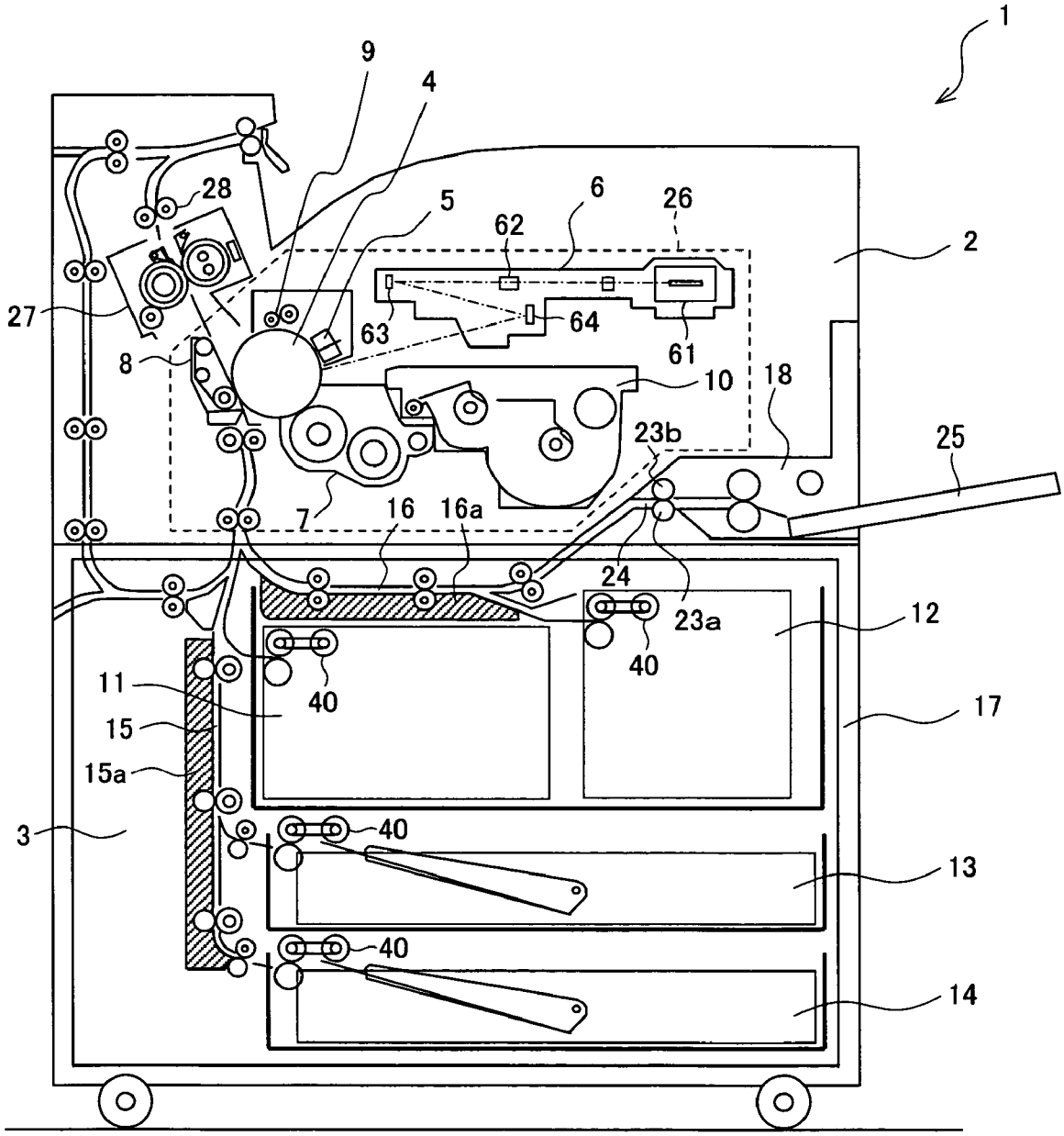
FIG. 2 is a cross-sectional view of the image forming apparatus of FIG. 1 in a usual state.

As shown in FIGS. 1 and 2, an image forming apparatus of the present embodiment is a printer including a sheet conveying apparatus of the present invention. FIGS. 1 and 2 are longitudinal cross-sectional views illustrating an image forming apparatus 1. First, an arrangement of the image forming apparatus 1 is described.

The image forming apparatus 1 includes a printer section 2, and a feed unit section 3 provided under the printer section 2.

At a substantially central position of the printer section 2, an electrophotographic process section 26 is provided. At a center of the electrophotographic process section 26 is a photosensitive drum 4. On a right side surface of the printer section 2, a manual feed unit 18 is provided.

The electrophotographic process section 26 includes an electric charger unit 5, an optical scanner unit 6, a development unit 7, a transfer unit 8, a cleaning unit 9, and a developer supply section 10, which are provided around the photosensitive drum 4.

The electric charger unit 5 evenly charges a surface of the photosensitive drum 4. By scanning an optical image, the optical scanner unit 6 writes an electrostatic latent image onto the photosensitive drum 4 that has been evenly charged. By using developer, the development unit 7 visualizes the electrostatic latent image written by the optical scanner unit 6.

The transfer unit 8 transfers the image visualized on the photosensitive drum 4 to an ordinary sheet or a special sheet (e.g. an OHP sheet (a synthetic resin sheet)). The cleaning unit 9 removes the developer that remains on the photosensitive drum 4, so that a new image can be recorded onto the photosensitive drum 4.

The remaining developer removed by the cleaning unit 9 is collected to the developer supply section 10 of the development unit 7, and recycled. The image forming apparatus 1 is not limited to an image forming apparatus that carries out a process of recycling remaining developer. The image forming apparatus 1 may be an image forming apparatus that collects and disposes the remaining developer.

Inside the optical scanner unit 6, there are provided a semiconductor laser light source (not shown), a rotative polygonal mirror 61, an fθ lens 62, mirrors 63 and 64, and the like. The rotative polygonal mirror 61 reflects a laser beam emitted from the semiconductor laser light source. The fθ lens 62 functions so that the laser beam reflected by the rotative polygonal mirror 61 performs scanning on the photosensitive drum 4 at a constant speed. The semiconductor laser light source emits a laser beam in accordance with image data transferred from an external apparatus such as a personal computer or a facsimile terminal, thereby forming, on the photosensitive drum 4, an electrostatic latent image that corresponds to the image data.

Above the electrophotographic process section 26, there is provided a fixing apparatus 27. The fixing apparatus 27 sequentially receives sheets onto which images have been transferred. Then, the fixing apparatus 27 applies heat to the developer that has been transferred onto the sheets, thereby fixing the developer onto the sheets. After that, the fixing apparatus 27 sends the sheets out of the fixing apparatus 27. The sheets on which images have been recorded are ejected from ejection rollers 28 of the printer section 2 to an upper surface of a main body of the image forming apparatus 1.

In spaces above and below the optical scanner unit 6, there are provided a printer control section, an image control section, a power supply unit, and the like, which are not shown. The printer control section contains a process control unit (PCU) substrate and an interface substrate. The PCU substrate controls an electrophotographic process. The interface substrate receives image data from outside the apparatus. The image control section includes an image control unit (ICU) substrate that performs predetermined image processing for the image data received by the interface substrate, and causes the optical scanner unit 6 to scan and record the image data as an image. The power supply unit supplies power to the foregoing substrates and units.

By using a pair of conveying rollers 23 including a driving roller 23*b* and a driven roller 23*a*, the manual feed unit (sheet conveying apparatus) 18 conveys a sheet placed on a feed tray 25 to the electrophotographic process section 26. The manual feed unit 18 is specifically described later.

Next, the feed unit section 3 is described.

The feed unit section 3 includes a plurality of feed trays 11, 12, 13, and 14. Because the feed trays 11 to 14 are provided, the feed unit section 3 can separately contain various sheets (recording mediums) according to sizes of the sheets, for example.

The image forming apparatus 1 selects one of the feed trays 11 to 14. Then, by using separating and supplying means 40, the image forming apparatus 1 separates sheets contained in the selected feed tray, and supplies one sheet at a time to a space between the photosensitive drum 4 and the transfer unit 8. To the sheet supplied, the transfer unit 8 transfers the image visualized on the photosensitive drum 4.

In FIG. 1, the feed tray 11 and the feed tray 12 are provided next to each other. The feed tray 13 and 14 are provided in this order below the feed tray 11 and the feed tray 12. The feed tray 13 and the feed tray 14 have equivalent capacities. Capacities of the feed tray 11 and the feed tray 12 are larger than those of the feed tray 13 and the feed tray 14.

The feed unit section 3 is provided with a third conveying path 15 and a fourth conveying path 16. The sheets contained in the feed trays 11 to 14 are conveyed via the third conveying path 15 or the fourth conveying path 16. Through the third conveying path 15, the sheets contained in the feed trays 11, 13, and 14 are conveyed toward the printer section 2. Through the fourth conveying path 16, the sheets contained in the feed tray 12 are conveyed toward the printer section 2.

The third conveying path 15 runs in a vertical direction along a frame 17 of the feed unit section 3. On the other hand, the fourth conveying path 16 runs in a horizontal direction along the frame 17.

Thus, inside the feed unit section 3, the feed trays 11 to 14, the third conveying path 15, and the fourth conveying path 16 are positioned efficiently. As a result, miniaturization of the feed unit section 3 is attained.

In order to set sheets in the feed tray 11 to 14, the feed tray to which the sheets are to be supplied is pulled out toward a front side of the main body of the image forming apparatus 1.

When a paper jam occurs in the third conveying path 15, a guide 15*a* (shaded area in the figure), which constitutes the third conveying path 15, is turned toward a user side. The guide 15*a* is turned on a fulcrum positioned at a back side of the feed unit section 3. Thus, it is possible to remove the sheet retained in the third conveying path 15. This removing operation is carried out in a work space that is created in advance between the third conveying path 15 and the frame 17.

Likewise, when a paper jam occurs in the fourth conveying path 16, a guide 16*a* (shaded area in the figure), which constitutes the fourth conveying path 16, is turned toward the user side. The guide 16*a* is turned on a fulcrum positioned at a back side of the feed unit section 3. Thus, it is possible to remove the sheet jammed in the fourth conveying path 16. This removing operation is carried out after creating a work space below the fourth conveying path 16 by pulling out, toward the user side, the feed tray 11 and the feed tray 12, which are provided next to each other.

The image forming apparatus 1 of FIG. 1 is arranged so that the feed trays 11 and 12 are pulled out simultaneously. However, the image forming apparatus 1 is not limited to this arrangement. The image forming apparatus 1 may be arranged so that the feed trays 11 and 12 can be pulled out independently from each other. In this case, in order to create, below the fourth conveying path 16, a work space for removing a sheet jammed in the fourth conveying path 16, it is sufficient to pull out the feed tray 11 toward the user side.

Described below is the manual feed unit (the sheet conveying apparatus) 18, which is a feature of the present invention.

The manual feed unit 18 is provided to a right side surface of the printer section 2. Thus, the manual feed unit 18 is provided in an upstream of the fourth conveying path 16. The manual feed unit 18 includes (i) the pair of conveying rollers 23 including the driving roller (roller) 23*b* and the driven roller (roller) 23*a*, (ii) the feed tray 25, (iii) and the like. On the feed tray 25, a relatively small number of sheets, and/or a special sheet are set. Examples of such a special sheet are (i) a thin sheet, (ii) a thick sheet such as a post card or the like, (iii) a colored sheet, and (iv) a sheet such as a plastic sheet, which is made of a material different from that of a usual sheet.

It is highly likely that a relatively special sheet is set on the feed tray 25. This is because it is easy to replace or set sheets on the feed tray 25 since the feed tray 25 sticks out of the side surface of the image forming apparatus 1. However, because sheets set on the feed tray 25 varies in materials, sizes, and the like, a feed status of the sheet set on the feed tray 25 becomes instable more easily than a feed status of sheets set in the feed trays 11 to 14. In particular, if a sheet set on the feed tray 25 does not fall within a range of a recommended sheet, the range being set in advance with respect to the manual feed unit 18, it is highly likely that the sheet is jammed in a conveying path.

In view of the circumstance, although not shown in the figure, both ends of the manual feed unit 18 are slidably supported by guiding rails or the like provided to a frame of the main body of the image forming apparatus 1. With this arrangement, the manual feed unit 18 is separated into a first unit A and a second unit B by moving the manual feed unit 18 in a direction substantially parallel to a sheet conveying direction from the feed tray 25 (in other words, in a direction perpendicular to a straight line that connects centers of the pair of conveying rollers 23*a* and 23*b*).

Specifically, as shown in FIG. 1, it is arranged so that the first unit A is pulled out rightward from the right side surface of the image forming apparatus 1, thereby creating a large opening at a conveying path that runs from the first conveying path 24 to the fourth conveying path 16. That is, as shown in FIG. 1, by pulling out the first unit A of the manual feed unit 18 from a state of the dotted line (a usual state) to a state of the solid line (an opened state), a work space S (the chain line in FIG. 1) is created.

Therefore, when the first unit A and the second unit B are separated in case a sheet is retained in the first conveying path 24, the sheet sandwiched by the pair of conveying rollers 23 is supported only by the driven roller 23*a*. Thus, the retained sheet P is exposed to the work space S, which is created by separating the first unit A and the second unit B. According to this arrangement, it is not necessary to pull out the sheet P from between the pair of conveying rollers 23. As a result, it is easy to perform operation (jam handling) for removing the retained sheet P. Moreover, because the work space S is created, maintenance of the manual feed unit 18 is easy.

It is preferable that the first unit A is pulled out in a direction opposite the sheet conveying direction from the feed tray 25. According to this arrangement, the driving roller 23*b*, which is also pulled out, is moved in a direction opposite the sheet conveying direction. That is, the driving roller 23*b* is moved in a direction of returning the conveyed sheet. As a result, it is possible to avoid moving the retained sheet P in the conveying direction, i.e. jamming the sheet P into the conveying direction. Moreover, because the sheet P is subjected to no stress if the driving roller 23*b* is moved in the direction opposite the sheet conveying direction, it becomes easier to perform the operation (the jam handling) for removing the retained sheet P.

In FIG. 1, it is arranged so that, out of the pair of conveying rollers 23 including the driven roller 23*a* and the driving roller 23*b*, the driving roller 23*b* is supported by the first unit A, and the driven roller 23*a* is supported by the second unit B (which is on a printer 2 side). According to this arrangement, after the first unit A and the second unit B are separated from each other and the sheet P jammed in the first conveying path 24 is removed, it is easy to respectively restore the first unit A and the second unit B into initial operable states thereof.

When the first unit A is pulled out, the driven roller 23*a* or the driving roller 23*b* is detached. That is, the first unit A may support the driven roller 23*a*, or may support the driving roller 23*b*. If the first unit A supports the driving roller 23*b*, a driving source for driving the driving roller 23*b* needs to be connected to the first unit A.

It is preferable that, when the first unit A is pulled out, the roller that remains on the second unit B is the lower one (in FIG. 2, the driven roller 23*a*) of the pair of conveying rollers 23. With this arrangement, the lower roller (in FIG. 2, the driven roller 23*a*) can support the sheet without fail, and it is possible to remove the sheet easily.

Figure 5:
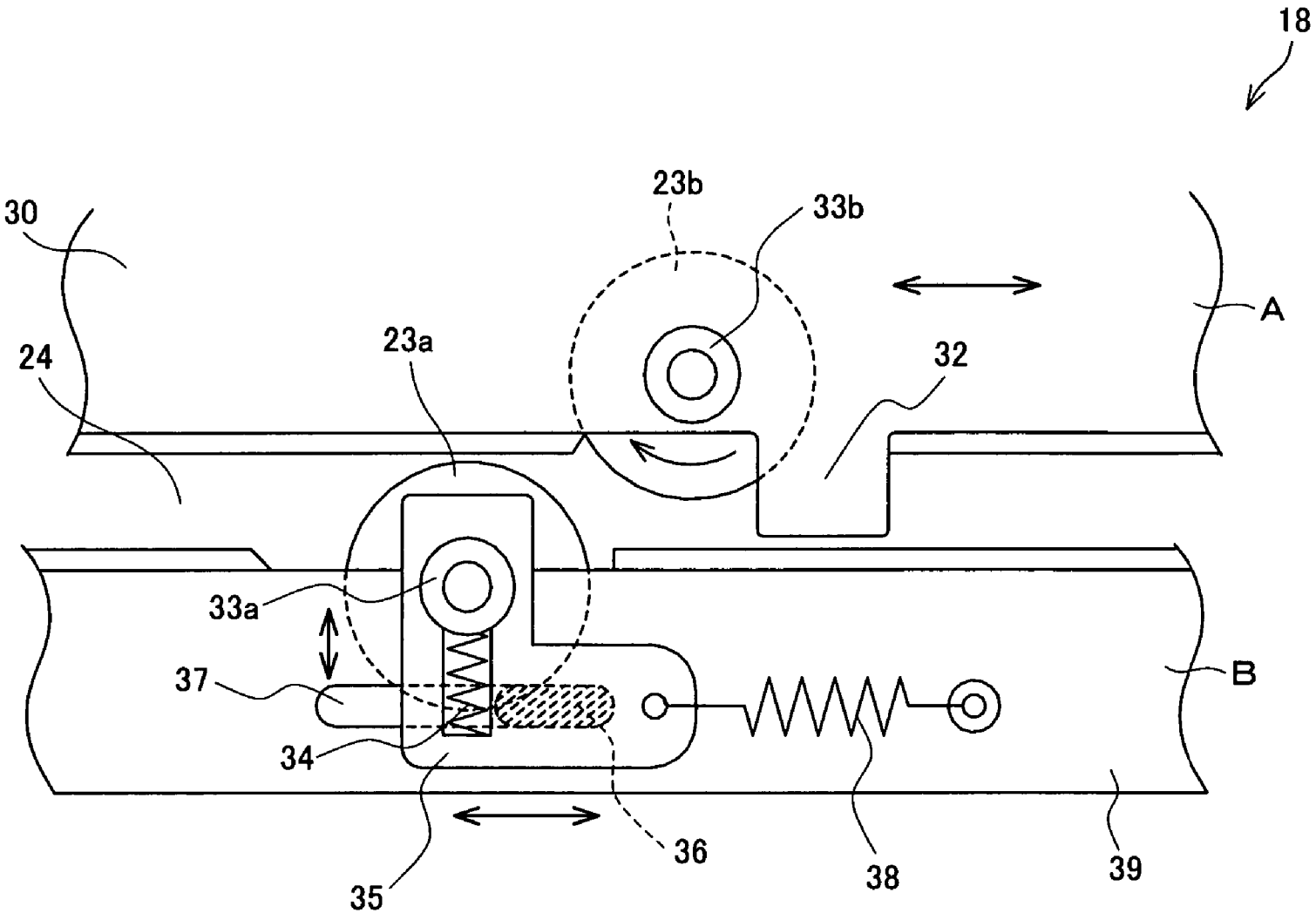
FIG. 5 is a partial cross-sectional view illustrating (i) how the sheet conveying apparatus of the present invention is restored to an initial position thereof after being pulled out, and (ii) an arrangement of a pair of conveying rollers.
Figure 6:
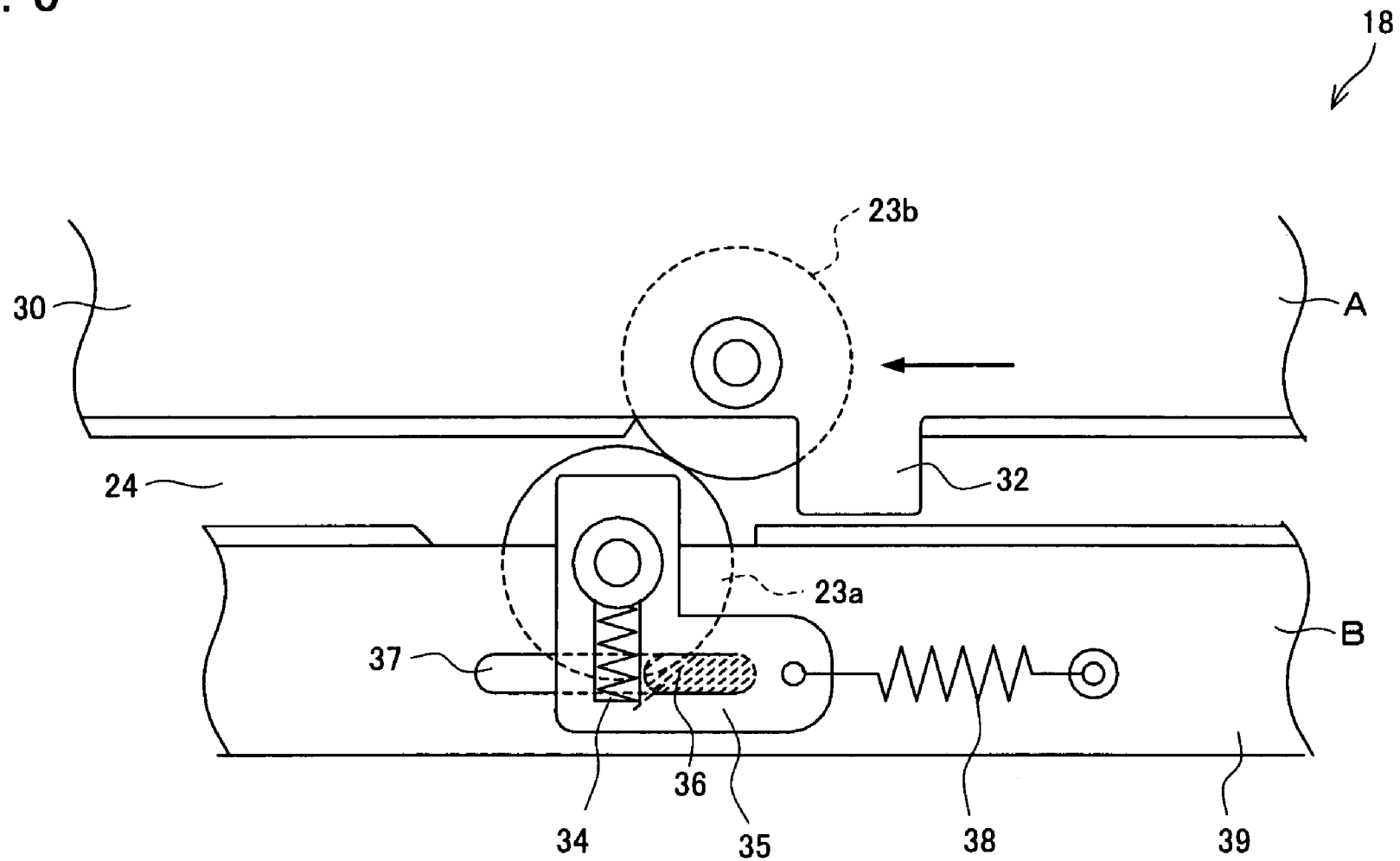
FIG. 6 is a partial cross-sectional view illustrating (i) how the sheet conveying apparatus of the present invention is restored to the initial position thereof after being pulled out, and (ii) the arrangement of the pair of conveying rollers.
Figure 7:
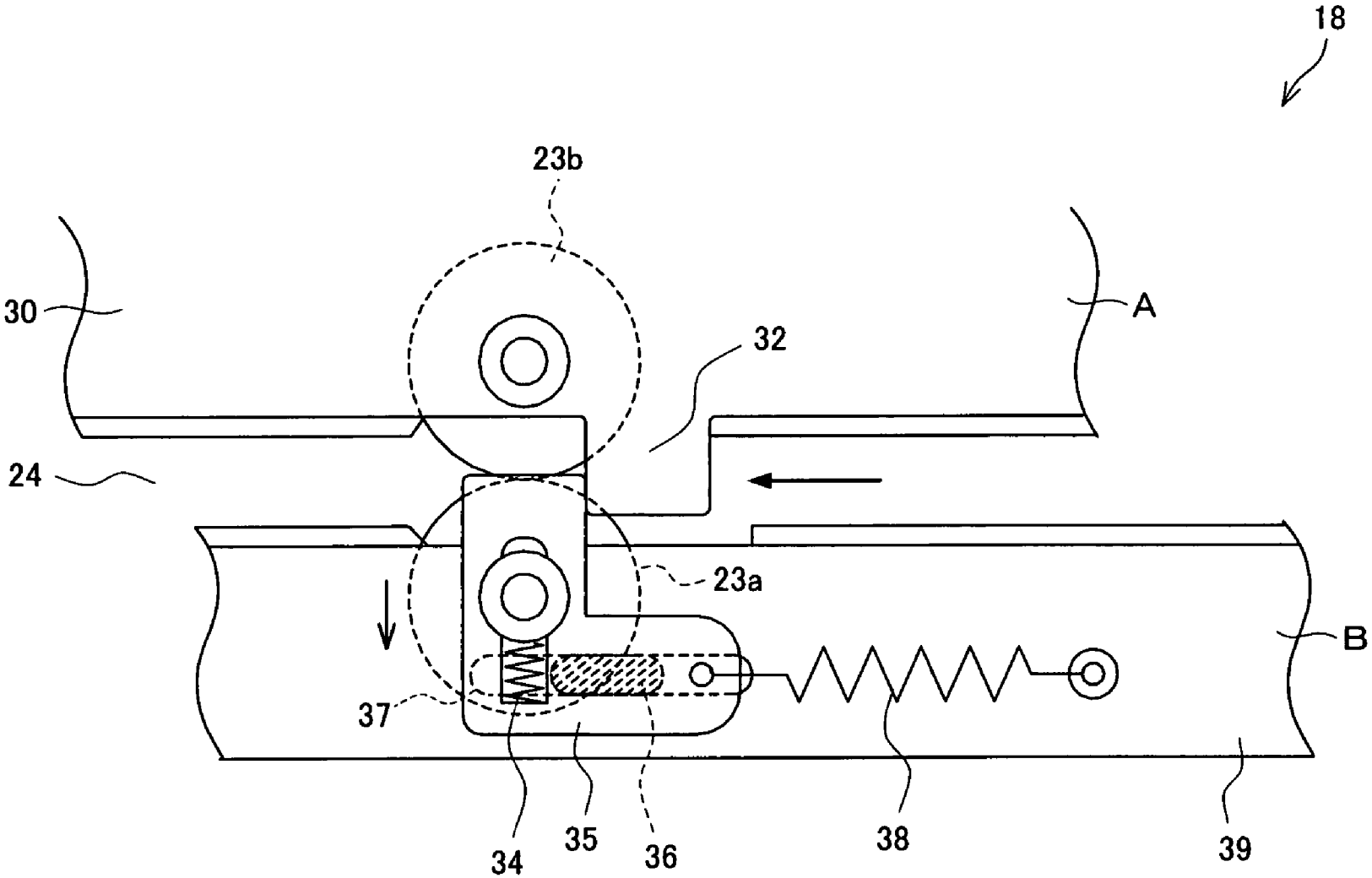
FIG. 7 is a partial cross-sectional view illustrating (i) how the sheet conveying apparatus of the present invention is restored to the initial position thereof after being pulled out, and (ii) the arrangement of the pair of conveying rollers.

Described below is operation of restoring the first unit A to an initial state thereof after the first unit A is pulled out and the sheet P retained in the first conveying path 24 is removed. FIGS. 5 to 7 illustrate the pair of conveying rollers 23 in an arrangement of the manual feed unit 18. The following describes operation of restoring the first unit A in case the driving roller 23*b* is supported by the first unit A, and the driven roller 23*a* is supported by the second unit B, as shown in FIG. 2.

When the first unit A is restored, the pair of conveying rollers 23, which are separated, are respectively restored to initial positions thereof, i.e. to a state in which the driven roller 23*a* and the driving rollers 23*b* are in contact with each other. When the driven roller 23*a* and the driving roller 23*b* contact each other, the rollers are subjected to a shock. The shock can cause damages to the rollers, displace a contact position of the pair of conveying rollers, and/or cause the rollers to be shaky. As a result, sheet conveying performance is deteriorated, and troubles such as skewing, wrinkling, and the like occur easily.

In view of the circumstance, at least one of the pair of conveying rollers 23*a* has an arrangement to avoid the troubles. The arrangement is specifically described below.

As shown in FIG. 5, the driving roller 23*b* is supported by the first unit A. The first unit A includes the driving roller 23*b*, a bearing 33*b*, a manual feed unit bottom guide 30, and a positioning convex portion 32. The bearing 33*b* is a bearing for the driving roller 23*b*. The manual feed unit bottom guide 30 guides an upper surface of a sheet to the sheet conveying path. The positioning convex portion 32 adjusts a position of the driving roller 23*b*. The driving roller 23*b* is supported by the bearing 33*b*. The driving roller 23*b* rotates clockwise as shown in the arrow in FIG. 5, thereby rotating the driven roller 23*a* counterclockwise. The driven roller 23*a* is supported by a bearing 33*a*. In this way, the sheet is conveyed from the feed tray 25 to the first conveying path 24.

As described above, the first unit A is movable in the direction substantially parallel to the first conveying path 24 (in the direction of the left right arrow in FIG. 5).

On the other hand, the driven roller 23*a* is supported by the second unit B. As shown in FIG. 5, the driven roller 23*a* has an arrangement for mitigating a pressure (shock) caused when the first unit A is restored to the initial position thereof after the first unit A is pulled out. That is, the driven roller 23*a* is supported on a conveying guide 39 of the second unit B by an L-shaped positioning and supporting block 35 and the bearing 33*a* via a tension spring 38.

The positioning and supporting block 35 has a convex guide portion 36. The conveying guide 39 has a guide hole 37 along which the convex guide portion 36 can move in a horizontal direction. With this arrangement, the driven roller 23*a* is movable in the horizontal direction within a range of the guide hole 37, when a pressure is applied to the driven roller 23*a* in the horizontal direction.

For example, in a usual state, the guide portion 36 is positioned in a middle of the guide hole 36, because a pressure in a vertical direction and a pressure in the horizontal direction are applied by the driving roller 23*b* to the driven roller 23*a*. On the other hand, when the first unit A is pulled out, the driven roller 23*a* is released from the pressures applied by the driving roller 23*b*, because the driving roller 23*b* is moved away from the driven roller 23*a*. Therefore, the tension spring 38 is contracted, and the convex guide portion 36 is positioned at a right end of the guide hole 37. When the first unit A is restored, a firm pressure is applied in the horizontal direction by the driving roller 23*b* to the driven roller 23*a*, when the driving roller 23*b* contacts the driven roller 23*a*. Therefore, the tension spring 38 is expanded, and the convex guide portion 36 is positioned at a left end of the guide hole 37. Thus, the convex guide portion 36 moves along the guide hole 37 horizontally (FIGS. 6 and 7).

Thus, one end of the tension spring 38 is connected to the conveying guide 39, and the other end of the tension spring 38 is connected to the positioning and supporting block 35. Because of contraction and expansion of the tension spring 38, the driven roller 23*a* is movable in the horizontal direction within the range of the guide hole 37. In this way, the tension spring 38 mitigates the pressure (shock) applied in the horizontal direction to the driven roller 23*a*. As a result, damages to the driven roller 23*a* are prevented.

As described above, it is possible to mitigate the shock caused when the pair of conveying rollers 23 is restored. That is, the positioning and supporting block 35, the convex guide portion 36, the guide hole 37, and the tension spring 38 function as a movable supporting member for supporting the driven roller 23*a* in such a manner that the driven roller 23*a* is movable in the horizontal direction. A pressing spring 34 plays a role of mitigating a pressure applied in the vertical direction by the driving roller 23*b*. Therefore, it is possible to prevent the rollers from being damaged by the shock.

Even if a pressure is applied in the horizontal direction to the positioning and supporting block 35 by the positioning convex portion 32 while the positioning convex portion 32 and the positioning and supporting block 35 are in contact with each other, the tension spring 38 is expanded. Thus, the guide convex portion is allowed to move in the direction in which the pressure is applied (the horizontal direction) along the guide hole 37. When the pressure is lifted, the tension spring 38 is contracted, and the driven roller 23*a* and the driving roller 23*b* are restored to the initial contact position.

In this way, the positioning convex portion 32 and the positioning and supporting block 35 certainly prevent deterioration of (i) positioning of the pair of conveying rollers 23 and (ii) a contact state of the pair of conveying rollers 23.

As described above, the sheet conveying apparatus 18 always maintains excellent sheet conveying performance, thereby preventing troubles such as skewing, wrinkling, and the like.

Figure 8:
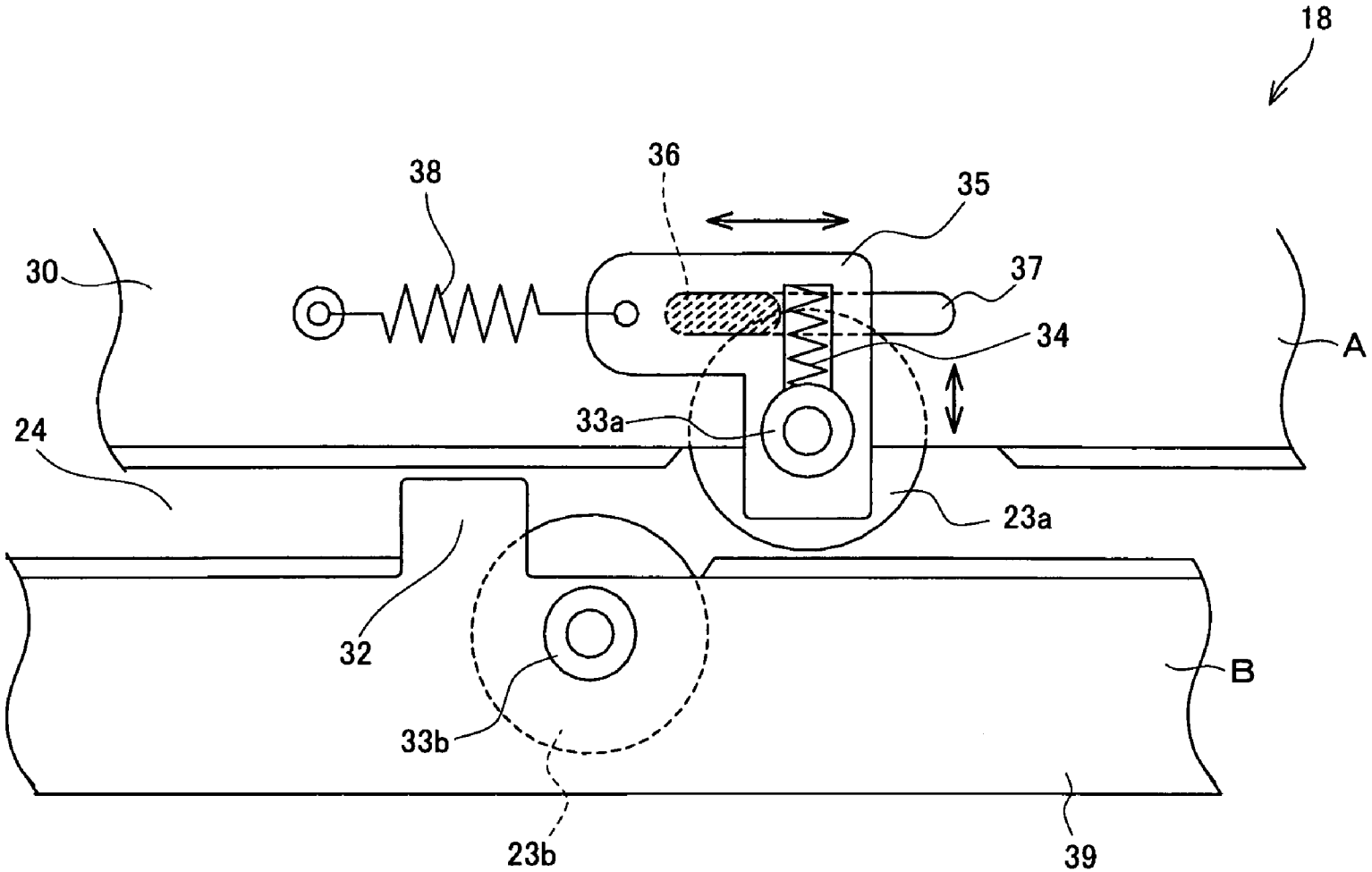
FIG. 8 is a partial cross-sectional view illustrating another arrangement of the pair of conveying rollers.

In FIGS. 5 to 7, the first unit A supports the driving roller 23*b*. However, as shown in FIG. 8, the first unit A may support the driven roller 23*a*. Operation is substantially the same between a case in which the first unit A supports the driving roller 23*b* and a case in which the first unit A supports the driven roller 23*a*. Therefore, description of the latter case is omitted.

It is preferable that the roller that remains supported by the second roller B when the first unit A is pulled out is the driving roller 23*b*. If the driven roller 23*a* is the roller that remains on the printer section 2, the first unit A, which supports the driving roller 23*b*, requires a complex arrangement. This is because the first unit A needs to be kept connected to the driving source while the first unit A is moved. The first unit A requires a complex arrangement also in case the driving roller 23*b* supported on the first unit A is moved while disconnected from the driving source. This is because the driving roller 23*b* and the driving source need to be connected again correctly, when the driving roller 23*b* is restored to the initial position thereof.

Moreover, in the sheet conveying apparatus 18 of the present invention, it is preferable that the roller supported by the movable supporting member is a driven roller 23*a*.

According to this arrangement, the roller provided with the movable supporting member for mitigating a shock is the driven roller 23*a*. That is, the driven roller 23*a* is the roller that mitigates a shock caused by a contact between the rollers when the first unit A is restored after a retained sheet is removed. Because the driven roller 23*a* requires no driving source, it is not necessary to consider a connection with a driving source, supply of power, and the like. As a result, the arrangement is simplified. If the driving roller 23*b* is supported by the movable supporting member, not only the driving roller 23*b* and the movable supporting member, but also a driving source needs to be connected. As a result, the arrangement becomes complex. In contrast, if the driven roller 23*a* is supported by the movable supporting member, it is possible to avoid the complexity of connecting the roller, the movable supporting member, and the driving source.

Moreover, in the sheet conveying apparatus 18 of the present invention, it is particularly preferable that the roller that is supported by the movable supporting member is the driven roller 23*a*, and the driven roller 23*a* is supported by the first unit A. An example of such a sheet conveying apparatus 18 is shown in FIG. 8. With this arrangement, because the driving roller 23*b* is not supported by the movable supporting member, it is possible to avoid the complex arrangement in which the driving roller 23*b*, the movable supporting member, and the driving source are connected. Moreover, because the first unit A supports the driven roller 23*a*, which requires no driving source, it is possible to avoid the first unit A from having a complex arrangement.

The roller (the driving roller 23*b* or the driven roller 23*a*) that remains supported by the second unit B when the first unit A is pulled out is pressed by the tension spring 38 in a direction toward the roller that is pulled out. The tension spring 38 is a compression coil spring or the like (such as a plate spring, a tension coil spring, and the like). With this arrangement, when the first unit A is restored to the initial position thereof, a sheet can be sandwiched in a conveyable manner by the driving roller 23*b* and the driven roller 23*a*. In the present embodiment, it is the first unit A that is pulled out. However, it may be the second unit B that is pulled out.

Second Embodiment

Figure 3:
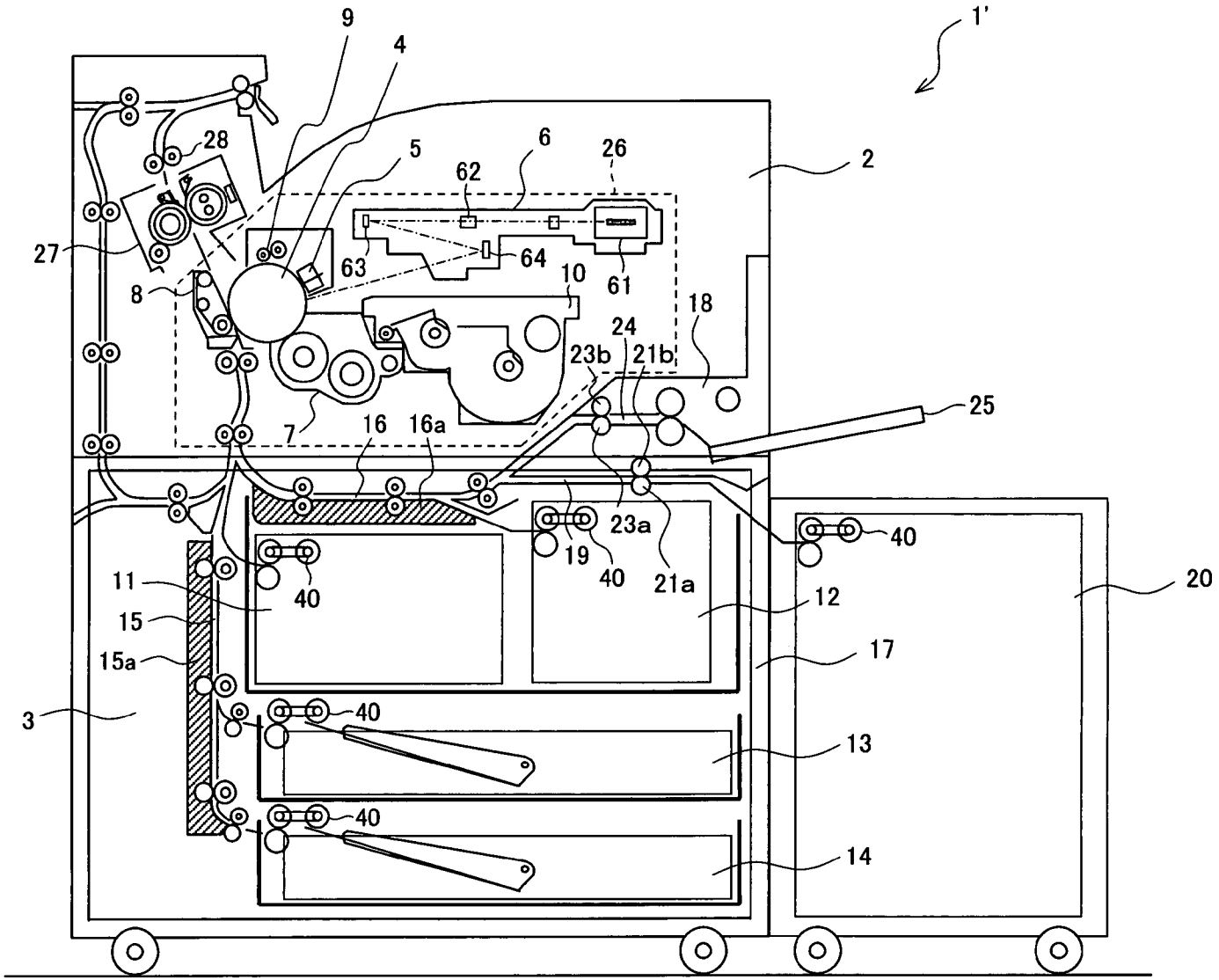
FIG. 3 is a cross-sectional view of an image forming apparatus of a second embodiment of the present invention in a usual state.
Figure 4:
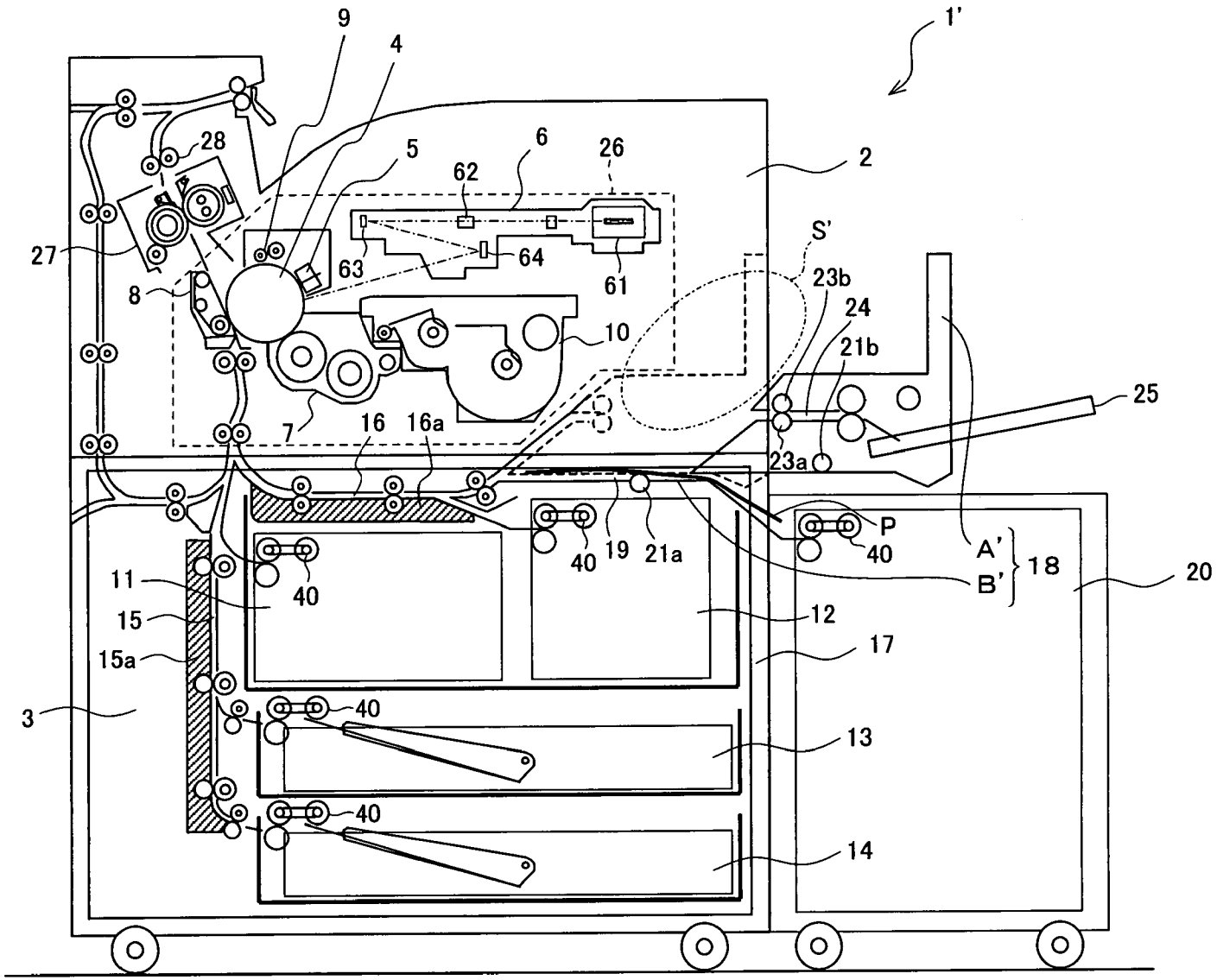
FIG. 4 is a cross-sectional view of the image forming apparatus of FIG. 3, where a sheet conveying apparatus is pulled out.

With reference to FIGS. 3 and 4, the following describes another embodiment of the present invention. For the purpose of explanation, members having identical functions with those of the members shown in FIG. 1 are labeled with identical referential numerals, and explanations thereof are omitted. Note that the following only describes differences of the present embodiment from the first embodiment.

As shown in FIGS. 3 and 4, an image forming apparatus of the present embodiment is a printer having a sheet conveying apparatus of the present invention. FIG. 3 is a cross-sectional view illustrating an arrangement of an image forming apparatus 1'. In the image forming apparatus 1', a feed unit 20 is provided on the right of a feed unit section 3, and connected with a manual feed unit 18. The feed unit 20 has a capacity larger than those of other feed trays 11 to 14. A sheet supplied from the feed unit 20 is conveyed to a printer section 2 via a second conveying path 19 and a fourth conveying path 16. A first conveying path 24 and the second conveying path 19 face each other. The second conveying path 19 is provided at a position lower than the first conveying path 24. The second conveying path 19 joins the first conveying path 24 in a downstream of the first conveying path 24.

Thus, in the image forming apparatus 1', the sheet conveying apparatus includes the manual feed unit 18 and the feed unit 20.

As in the case of the image forming apparatus 1, the sheet conveying apparatus including the manual feed unit 18 and the feed unit 20 is such that a third unit A and/or a fourth unit B can be pulled out. Thus, the manual feed unit 18 can be separated into the third unit A and the fourth unit B'. As shown in FIG. 4, the third unit A and/or the fourth unit B can be pulled out, so that a space including a connecting part between the first conveying path 24 and the second conveying path 19 is created.

In FIGS. 3 and 4, out of (i) a pair of conveying rollers 23 (a first pair of conveying rollers) including a driven roller 23*a* and a driving roller 23*b* and (ii) a pair of conveying rollers 21 (a second pair of conveying rollers) including a driven roller 21*a* and a driving roller 21*b*, the first pair of conveying rollers (the driven roller 23*a* and the driving roller 23*b*) and the driving roller 21*b* are supported by the third unit A', and the driven roller 21*a* is supported by the fourth unit B'. (on the printer section 2). It is arranged so that, after a sheet P jammed in the second conveying path 19 is removed, the third unit A' and the fourth unit B', which are separated, can be easily restored to an initial operable state. The first pair of conveying rollers 23 and the second pair of conveying rollers 21 face each other.

As in the case described above, in the image forming apparatus 1', when a sheet is retained in the second conveying path 19 due to a paper jam or the like, it is possible to create a workspace S (the chain line in FIG. 4) by pulling out the third unit A'. As a result, it is easy to perform operation (jam handling) for removing the retained sheet P, because it is not necessary to pull out the sheet from between the second pair of conveying rollers 21. Moreover, because the work space S' is created, maintenance of the manual feed unit 18 and the feed unit 20 is easy.

Specific operation in the jam handling is identical to the operation described above with reference to FIGS. 5 to 7. Therefore, explanation of the jam handling is omitted. However, in the case of the image forming apparatus 1', the driven roller 23*a* in FIGS. 5 to 7 is the driven roller 21*a*, the driving roller 23*b* in FIGS. 5 to 7 is the driving roller 21*b*, the first unit A in FIGS. 5 to 7 is the third unit A', and the second unit B in FIGS. 5 to 7 is the fourth unit B'.

As described above, according to the image forming apparatus 1' of the present embodiment, the third unit A' and the fourth unit B' are separable from each other. With this arrangement, when the third unit A' and the fourth unit B' are separated in a direction substantially parallel to a sheet conveying direction, a large work space S' is created at an initial position of the third unit A'. Thus, the second conveying path 19, including the connecting part with the first conveying path 24, is opened. At the same time, the second pair of conveying rollers (the driven roller 21*a* and the driving roller 21*b*) are also separated from each other.

Therefore, when the third unit A' and the fourth unit B' are separated in case the sheet P is retained in the second conveying path 19, the sheet P sandwiched between the second pair of conveying rollers is supported only by the driven roller 21*a*. The retained sheet P is thus exposed to the work space S created by separating the third unit A and the fourth unit B'. As a result, it is easy to perform the operation (the jam handling) for removing the retained sheet P, because it is not necessary to pull out the sheet from between the second pair of conveying rollers 21. Moreover, because the work space S is created, maintenance is easy.

Thus, the arrangement of the image forming apparatus 1 is substantially identical to that of the image forming apparatus 1 of the first embodiment. Therefore, the image forming apparatus 1 can attain effects of the image forming apparatus 1.

In the present embodiment, the process of pulling out the third unit A and removing the sheet P jammed in the second conveying path 19 is described. However, by arranging the third unit A as a separable unit so that one of the pair of conveying rollers 23 can be pulled out, it becomes easy to remove a sheet jammed in the first conveying path 24.

In the image forming apparatus 1 of the first embodiment and the image forming apparatus 1 of the second embodiment, the manual feed unit 18 and/or the feed unit 20 is slidable from the main body of the image forming apparatus 1 or 1'. Therefore, by sliding the manual feed unit 18 and/or the feed unit 20, it is possible to pull out the manual feed unit 18 and/or the feed unit 20 from the image forming apparatus 1 or 1'. With this arrangement, even if a sheet conveyed from the manual feed unit 18 or the feed unit 20 is jammed in the fourth conveying path 16, it is possible to easily perform maintenance of the fourth conveying path 16 by sliding the manual feed unit 18 or the feed unit 20.

In the first embodiment and the second embodiment, arrangements of printers are described. However, other than a printer, the present invention may be applied to an image forming apparatus such as a facsimile, a copying apparatus, or the like. In case the sheet conveying apparatus of the present invention is used in an image forming apparatus, the sheet conveying apparatus may be called "a sheet supplying and ejecting apparatus", which plays (i) a role of supplying a sheet to the printer section 2, and (ii) a role of conveying the sheet to the image forming apparatus 1 or 1', and ejecting the sheet outward.

The present invention is not limited to the foregoing embodiments. The present invention may be varied in many ways within the scope of the claims. Within the scope of the present invention, an embodiment made by combining technical means disclosed in different embodiments is also included.

As described above, a sheet conveying apparatus of the present invention includes a first unit and a second unit that are separable from each other, the first unit having one of a pair of conveying rollers, and the second unit having the other of the pair of conveying rollers.

Moreover, a sheet conveying apparatus of the present invention includes a third unit and a fourth unit that are separable from each other, the third unit having a first pair of conveying rollers and one of a second pair of conveying rollers, and the fourth unit having the other of the second pair of conveying rollers.

According to these arrangements, a sufficient work space is created between (i) the conveying path for conveying a sheet and (ii) the first unit or the third unit. As a result, it is possible to put a hand deep into the conveying path, and pull out a sheet retained.

When the units are separated, the conveying rollers are separated from each other. Thus, a sheet is exposed to the conveying path. Therefore, without tearing the sheet, it is possible to release the sheet sandwiched between conveying members. As a result, it is possible to remove the retained sheet more easily.

Moreover, because the sheet retained in the conveying path can be removed easily by simply separating the units, it is possible to simplify the arrangement of the sheet conveying apparatus.

As described above, an image forming apparatus of the present invention includes (i) the sheet conveying apparatus and (ii) a printing apparatus for performing printing on a sheet.

With this arrangement, because the sheet conveying apparatus of the present invention is used, it is possible to provide an image forming apparatus arranged so that a work space can be created and a jammed sheet can be removed easily, especially in case a sheet is jammed on its way from the sheet conveying apparatus to the printing apparatus.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A sheet conveying apparatus comprising a manual feed unit including:

(i) a feed tray, (ii) a pair of conveying rollers for sandwiching a sheet and conveying the sheet in a predetermined direction, and (iii) a supporting body for supporting the pair of conveying rollers, wherein said manual feed unit conveys a sheet placed on the feed tray via a conveying path through which said sheet is conveyed by said pair of conveying rollers, and the supporting body includes:

(a) a first unit having one of said pair of conveying rollers and (b) a second unit having the other of said pair of conveying rollers, and said first unit and said second unit are separable from each other in a direction substantially parallel to said conveying path.

2. The sheet conveying apparatus as set forth in claim 1, wherein:

one of said first unit and said second unit is detachable in a direction opposite a sheet conveying direction.

3. A sheet conveying apparatus comprising:

(i) a pair of conveying rollers for sandwiching a sheet and conveying said sheet in a predetermined direction, and (ii) a supporting body for supporting the pair of conveying rollers, wherein:

said sheet conveying apparatus conveys said sheet via a conveying path through which said sheet is conveyed by said pair of conveying rollers, said supporting body includes:

(a) a first unit having one of said pair of conveying rollers, and (b) a second unit having the other of said pair of conveying rollers, and said first unit and said second unit are separable from each other, and wherein:

at least one of said pair of conveying rollers is supported on said first unit or said second unit by a movable supporting member in such a manner that the at least one of said pair of conveying rollers is movable in a direction substantially parallel to a direction separating said first unit and said second unit.

4. The sheet conveying apparatus as set forth in claim 3, wherein:

said movable supporting member includes:

(i) a positioning and supporting block connected to a bearing to which said at least one of said pair of conveying rollers is connected, and (ii) a tension spring having one end connected to a conveying guide of one of said first unit and said second unit and the other end connected to said positioning and supporting block;

said one of said first unit and said second unit includes said movable supporting member;

said positioning and supporting block includes a convex guide portion;

said conveying guide has a guide hole along which said convex guide portion is movable in a horizontal direction; and when said positioning and supporting block is moved in accordance with a pressure applied in the horizontal direction, said tension spring is contracted or expanded, so as to allow said convex guide portion to move in the horizontal direction along said guide hole.

5. A sheet conveying apparatus as set forth in claim 4, further comprising:

a positioning convex portion provided to a one of said first unit and said second unit that does not have the movable supporting member, wherein when said positioning and supporting block is moved in accordance with a pressure applied by said positioning convex portion, said tension spring is contracted or expanded so as to allow said convex guide portion to move in the horizontal direction along said guide hole.

6. The sheet conveying apparatus as set forth in claim 3, wherein:

said roller supported by said movable supporting member is a driven roller.

7. The sheet conveying apparatus as set forth in claim 1, wherein:

only one of said first unit and said second unit is a movable unit when said first unit and said second unit are separated from each other; and one of said pair of conveying rollers is mounted to said movable unit and driven.

8. A sheet conveying apparatus comprising:

(i) a first pair of conveying rollers for sandwiching a sheet and conveying the sheet in a predetermined direction, (ii) a second pair of conveying rollers for sandwiching a sheet and conveying the sheet in a predetermined direction, said first pair of conveying rollers and said second pair of conveying rollers facing each other, and (iii) supporting bodies for respectively supporting said first pair of conveying rollers and said second pair of conveying rollers, wherein said sheet conveying apparatus includes a first conveying path and a second conveying path, said first conveying path and said second conveying path facing one another, and said sheet conveying apparatus conveys sheets through said first conveying path and said second conveying path, said first conveying path conveying a sheet by said first pair of conveying rollers, said second conveying path conveying a sheet by said second pair of conveying rollers, and said second conveying path being connected with said first conveying path downstream of said first pair of conveying rollers provided in said first conveying path, said supporting bodies include:

(a) a third unit supporting said first pair of conveying rollers and one of said second pair of conveying rollers, and (b) a fourth unit supporting the other of said second pair of conveying rollers, and said third unit and said fourth unit are separable from each other.

9. The sheet conveying apparatus as set forth in claim 8, wherein:

said third unit and said fourth unit are separable in a direction substantially parallel to said first conveying path and said second conveying path.

10. A sheet conveying apparatus comprising:

(i) a first pair of conveying rollers for sandwiching a sheet and conveying the sheet in a predetermined direction, (ii) a second pair of conveying rollers for sandwiching a sheet and conveying the sheet in a predetermined direction, said first pair of conveying rollers and said second pair of conveying rollers facing each other, and (iii) supporting bodies for respectively supporting said first pair of conveying rollers and said second pair of conveying rollers, wherein said sheet conveying apparatus conveys sheets through said first conveying path and said second conveying path, said first conveying path being a conveying path through which a sheet is conveyed by said first pair of conveying rollers, said second conveying path being a conveying path through which a sheet is conveyed by said second pair of conveying rollers, and said second conveying path being connected with said first conveying path downstream of said first pair of conveying rollers provided in said first conveying path, said supporting bodies include:

(a) a third unit having the first pair of conveying rollers and one of said second pair of conveying rollers, and (b) a fourth unit having the other of said second pair of conveying rollers, and said third unit and said fourth unit are separable from each other, and further wherein: one of said third unit and said fourth unit is detached in a direction opposite to a sheet conveying direction.

11. The sheet conveying apparatus as set forth in claim 10, wherein:

at least one of said second pair of conveying rollers is supported on said third unit or said fourth unit by a movable supporting member in such a manner that said at least one of said second pair of conveying rollers is movable in a direction substantially parallel to a direction of separating said third unit and said fourth unit.

12. The sheet conveying apparatus as set forth in claim 11, wherein:

said roller supported by said movable supporting member is a driven roller.

13. An image forming apparatus, comprising:

a sheet conveying apparatus including a manual feed unit having:

(i) a feed tray, (ii) a pair of conveying rollers for sandwiching a sheet and conveying the sheet in a predetermined direction and (iii) a supporting body for supporting said pair of conveying rollers, wherein said sheet conveying apparatus conveys said sheet placed on the feed tray via a conveying path through which said sheet is conveyed by said pair of conveying rollers, and said supporting body includes:

(a) a first unit having one of said pair of conveying rollers and (b) a second unit having the other of said pair of conveying rollers, and said first unit and said second unit are separable from each other in a direction substantially parallel to said conveying path.

14. An image forming apparatus, comprising:

a sheet conveying apparatus including (i) a first pair of conveying rollers for sandwiching a sheet and conveying the sheet in a predetermined direction, (ii) a second pair of conveying rollers for sandwiching a sheet and conveying the sheet in a predetermined direction, said first pair of conveying rollers and said second pair of conveying rollers facing each other, and (iii) supporting bodies for respectively supporting said first pair of conveying rollers and said second pair of conveying rollers, wherein said sheet conveying apparatus includes a first conveying path and a second conveying path, said first conveying path and said second conveying path facing one another, and said sheet conveying apparatus conveys sheets through said first conveying path and said second conveying path, said first conveying path conveying a sheet by said first pair of conveying rollers, said second conveying path conveying a sheet by said second pair of conveying rollers, and said second conveying path being connected with said first conveying path downstream of said first pair of conveying rollers provided in said first conveying path, said supporting bodies include:

(a) a third unit supporting said first pair of conveying rollers and one of said second pair of conveying rollers, and (b) a fourth unit supporting the other of said second pair of conveying rollers, and said third unit and said fourth unit are separable from each other.

* * * * *